United States Patent [19]

Kurtz

[11] Patent Number: 5,044,758

[45] Date of Patent: Sep. 3, 1991

[54] CAULK AND TRANSFER APPARATUS

[76] Inventor: William Kurtz, 30 Elaine Ave., Mill Valley, Calif. 94941

[21] Appl. No.: 327,780

[22] Filed: Mar. 23, 1989

Related U.S. Application Data

[63] Continuation-in-part of Ser. No. 305,074, Feb. 2, 1989, abandoned.

[51] Int. Cl.[5] ..... B01F 7/16; B01F 15/02

[52] U.S. Cl. ..... 366/77; 141/245; 141/258; 366/98; 366/184; 366/194; 366/205; 366/314; 366/605

[58] Field of Search ..... 366/42, 50, 77, 79, 366/184, 186, 189, 190, 194, 191, 205, 195, 279, 314, 318, 343, 344, 349, 605, 245-251; 141/98, 242, 244, 245, 258

[56] References Cited

U.S. PATENT DOCUMENTS

| | | | |
|---|---|---|---|
| 496,141 | 4/1893 | Simms | 141/242 |
| 642,640 | 2/1900 | Smith | 141/242 |
| 1,690,067 | 10/1928 | Weeks | 141/172 |
| 3,144,966 | 8/1964 | Cook | 366/191 |
| 3,153,531 | 10/1964 | Cook | 366/191 |
| 4,124,308 | 11/1978 | Sokolow | 366/77 |
| 4,254,806 | 3/1981 | Elsworth | 141/129 |
| 4,297,036 | 10/1981 | Schroder | 366/79 |
| 4,373,560 | 2/1983 | Elsworth | 141/129 |
| 4,497,578 | 2/1985 | Simpson | 366/190 |
| 4,817,685 | 4/1989 | Skerchock et al. | 141/258 |

*Primary Examiner*—Timothy F. Simone
*Attorney, Agent, or Firm*—Douglas E. White

[57] ABSTRACT

A caulk mix and transfer apparatus includes a caulk jar for holding uncolored caulk and for receiving unmixed pigment. The jar has a mix lid and a transfer lid. Empty caulk tubes are attached to the transfer lid and the mix lid includes a rotatable blade. A machine for mixing the pigment and caulk in the caulk jar and for transferring the mixture to the caulk tubes includes means for engaging the jar and mixing the pigment and caulk therein with the mix lid and includes means for engaging the jar and transferring the mixture to the caulk tubes through the transfer lid.

11 Claims, 4 Drawing Sheets

CAULK AND TRANSFER APPARATUS

This application is a continuation-in-part of my copending application No. 07/305,074, filed Feb. 2, 1989, not abandoned.

FIELD OF THE INVENTION

This invention relates to apparatus for mixing and dispensing viscous fluids, more particularly to an apparatus for tinting caulk to match a selected color of paint.

BACKGROUND OF THE INVENTION

On-site paint mixing has long been available at retail outlets such as paint stores and hardware stores. This offers great convenience and savings of time, both for lay consumers and for professional contractors.

Caulk sealant is used to join, for example, wood or synthetic trim to painted surfaces; laminates at their seams or to walls; sinks to counters, flooring to painted, laminated or wood surfaces; and so on. Traditionally, caulk could only be purchased in the color white. Recently, a limited range of fixed colors became available on the retail level. One company will provide, from its factory, caulks with colors which are custom matched to a particular manufacturer's laminates.

To date, no company is known to have produced an apparatus which allows the contractor or the home hobbyist to go to his local paint store, present a color sample to be matched, and purchase tubes of caulk specifically blended on the store's premises to duplicate the color of his paint, tile, laminate, or the like. The problem has been that, unlike paint, caulk is very viscous. Therefore, there are problems in mixing the tinting agent with the caulk and in dispensing the caulk into the tubes which are used in caulk guns, since it cannot readily be poured.

The advantage of having color matched caulk is that a great saving of time is possible. The user does not have to apply the paint itself with precision at joining edges or, alternatively, does not have to paint over white caulk previously applied. The user may first paint next to, but not exactly on, the joint and then afterwards fill in the unpainted surface with caulk.

Prior developments in this field may be generally illustrated by reference to the following patents:

| Patent No. | Patentee | Issue Date |
|---|---|---|
| 3,951,387 | F. Warden et al. | 04/20/76 |
| 2,965,363 | L. D. Worden | 12/20/60 |
| 2,927,410 | L. Doyen et al. | 03/08/60 |
| 4,190,371 | H. Durr et al. | 02/26/80 |
| 3,516,220 | C. G. Buford et al. | 06/23/70 |
| 1,446,047 | G. J. Keller et al. | 02/20/23 |
| 4,758,096 | K. Gunnarsson | 07/19/88 |
| 2,831,606 | M. E. Alters | 04/22/58 |

Most of these patents teach mixing systems and filling systems in which pistons are used to displace the product and are representative of what is in that art.

The patent to Alters, U.S. Pat. No. 2,831,606, shows a single container being used both for stirring and dispensing. However, it does not collapse—rather, it uses a plunger which is combined with the stirrer. Worden, in U.S. Pat. No. 2,965,363, shows a system that dispenses color and then mixes it in containers.

SUMMARY OF THE INVENTION

The present invention comprises a machine for mixing pigment into bulk caulk (i.e. unpigmented or base pigmented caulk) to produce custom colored caulk. The machine also transfers the colored caulk from the bulk container or jar to caulk tubes of sizes which fit standard caulk guns. The capacity of the bulk jar is fixed to match that of the tubes.

A new bulk jar for shipping and storing the uncolored caulk is disclosed. The pigment may be added to the jar at the point of sale through standard apparatus like that already in use for dispensing pigment into paint bases. However, the caulk is too thick to mix by shaking it in the manner of the custom coloring paint apparatus. The bulk jar, therefore, includes a mixing lid having a built-in stirring blade for mixing the pigment after it is dispensed into the jar.

Once mixed, the jar is inverted, i.e. its outside is turned inward by a ram which supplies pressure to the bottom of the jar via a head or piston. This forces substantially all of the caulk out through a separate transfer lid into a plurality, preferably three, of caulk tubes. A motor or motors are provided to drive, first, the mixing lid and, next, the ram.

The bulk jar may be blow-molded out of a suitable resilient plastic such as polyethylene. The two lids may also be made inexpensively out of plastic in order that the lids and the jar may be disposed of after a single use, to eliminate the need for repetitive cleaning.

The caulk tubes carried by the transfer lid may be of the ordinary open-ended plunger type. However, they may also be blow-molded out of polyethylene or the like so as also to be invertible by the ram piston of the caulk gun, in the manner of the bulk jars of the present invention.

FEATURES AND ADVANTAGES

A feature of this invention is a machine for mixing pigment and caulk in a caulk jar having at least one lid and for transferring the mixture to caulk tubes, which machine includes means for engaging the jar and mixing the pigment and caulk therein and also includes means for engaging the jar and transferring the mixture to the caulk tubes.

A further feature is that the engaging and mixing means includes a socket for engaging the jar and means for rotating the jar lid. The engaging and transferring means includes a compression tube for engaging the jar and means for pushing the mixture into the caulk tubes.

Another feature is a ram in the machine having a piston, which piston ejects the caulk from the jar into the tubes.

Yet another strong feature is a caulk jar which includes a transfer lid onto which the caulk tubes are removably attached, the caulk tubes being able to enter into fluid communication with the jar.

Another feature is a mix lid having means for mixing caulk in the jar.

Further features include a spirally curved rotatable blade and a rotator in the mix lid.

Another important feature is that the caulk jar is formed of one continuous piece of flexible plastic forming a wall and a bottom. This allows the jar to be inverted into itself so as to eject the caulk and transfer it through the transfer lid into the caulk tubes.

Other novel features which are characteristic of the invention, as to organization and method of operation, together with further objects and advantages thereof will be better understood from the following description considered in connection with the accompanying drawing in which a preferred embodiment of the invention is illustrated by way of example. It is to be expressly understood, however, that the drawing is for the purpose of illustration and description only and is not intended as a definition of the limits of the invention.

Certain terminology and derivations thereof may be used in the following description for convenience in reference only and will not be limiting. For example, the words "upwardly," "downwardly," "leftwardly," and "rightwardly" will refer to directions in the drawings to which reference is made. The words "inwardly" and "outwardly" will refer to directions toward and away from, respectively, the geometric center of a device and designated parts thereof.

DRAWING REFERENCE NUMERALS

Figure 1:
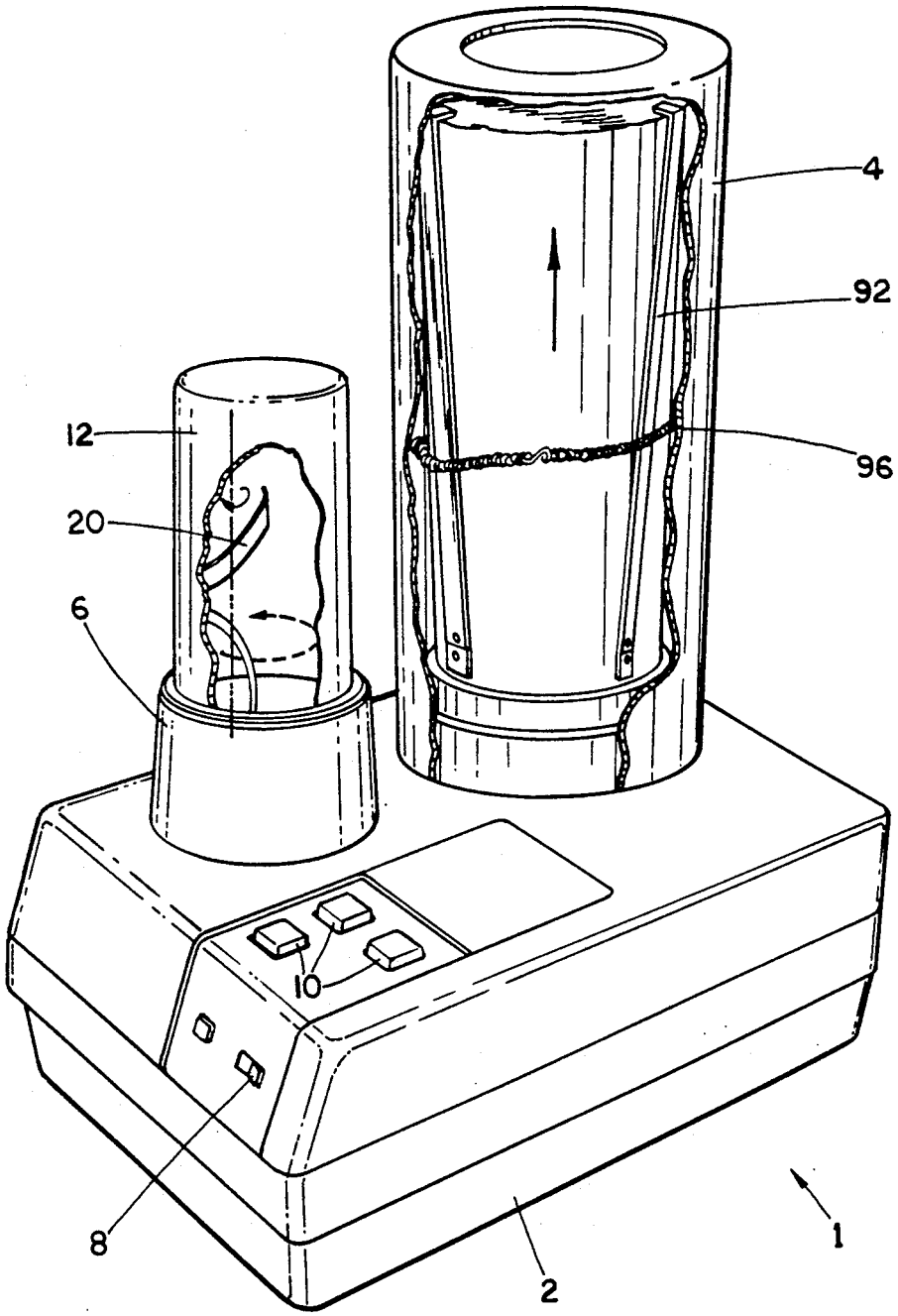
FIG. 1 is a perspective view in partial section of a preferred embodiment of the mix and transfer machine of this invention.

| Drawing Reference Numerals | |
|---|---|
| 1 | mix and transfer machine |
| 2 | encasement |
| 4 | compression tube shroud |
| 6 | jar socket |
| 8 | power switch |
| 10 | button array |
| 12 | jar |
| 13 | caulk |
| 14 | mix lid |
| 16 | rotator of 14 |
| 18 | cap of 16 |
| 20 | blade of 14 |
| 22 | knob of 20 |
| 26 | transfer lid |
| 28 | caulk tube |
| 30 | plunger of 28 |
| 32 | nozzle of 28 |
| 34 | aperture in 26 |
| 40 | rotator |
| 42 | socket |
| 44 | rotation disk |
| 46 | base disk |
| 48 | gear of 42 |
| 50 | bearing of 42 |
| 52 | gear of 44 |
| 54 | motor |
| 55 | mount of 54 |
| 56 | drive shaft of 54 |
| 58 | gear of 56 |
| 60 | bearing of 44 |
| 70 | linear actuator |
| 72 | base of 70 |
| 74 | screw of 70 |
| 76 | nut of 70 |
| 78 | anti-rotation pins |

-continued

| Drawing Reference Numerals | |
|---|---|
| 80 | ram |
| 82 | shroud of 80 |
| 84 | head or piston of 80 |
| 86 | hinge of 80 |
| 88 | flap of 80 |
| 90 | compression tube |
| 92 | stop arm |
| 94 | finger of 92 |
| 95 | spacer of 92 |
| 96 | spring |
| 97 | clip of 96 |
| 98 | actuator of 92 |
| 112 | jar |
| 113 | caulk |
| 115 | threads of 112 |
| 119 | plunger of 112 |
| 126 | transfer lid |
| 184 | ram head or piston |

DESCRIPTION OF A PREFERRED EMBODIMENT

Referring to FIG. 1, there is illustrated therein a caulk mix and transfer machine 1 of this invention with a preferred bulk container or jar 12 inserted into the jar socket 6 of the machine. An encasement 2 of molded plastic protects some internal components of the machine 1 and an upwardly projecting compression tube shroud 4 protects others.

A switch 8 provides electrical power to the machine. An array of buttons 10 controls machine operations, such as mixing, transferring and resetting.

Figures 2, 3:
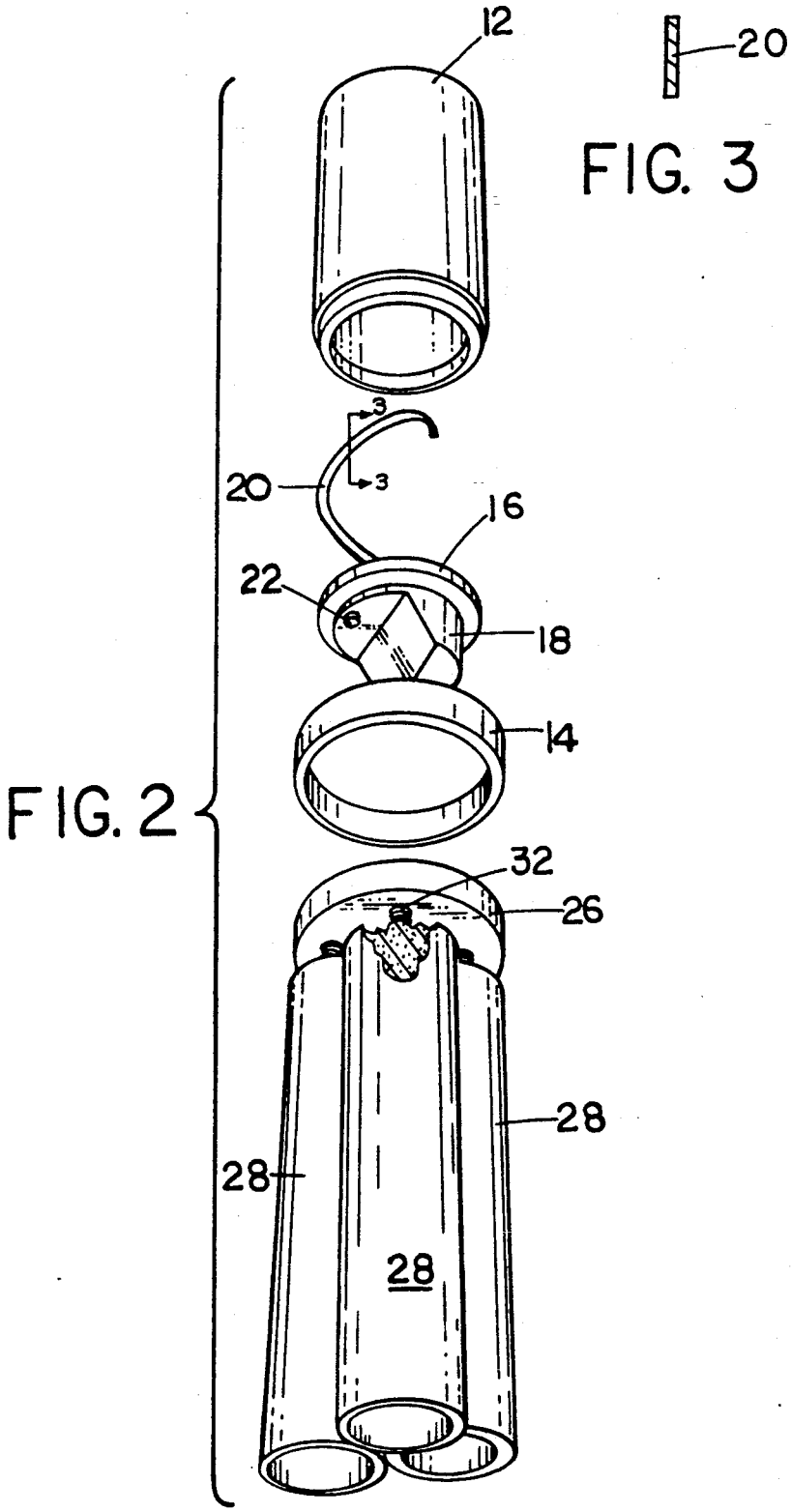
FIG. 2 is an exploded view of the preferred bulk jar of the invention showing, sequentially, the mix lid and the transfer lid assemblies.
FIG. 3 is a sectional view of the blade of FIG. 2 taken along line 3—3 of FIG. 2.

Turning to FIG. 2, one can see an exploded view of the jar 12 and its mix lid 14 and transfer lid 26, it being understood that only one lid is used at a time. The mix lid is used during the mixing cycle of the machine. It may also be used for shipment of the bulk caulk 13 prior to mixing and sale if a separate shipping lid is not provided for this purpose.

The mix lid 14 encircles a rotator 16, the latter of which has a projecting lobe or force transmitting cap 18. A mixing blade 20 is connected to the rotator through an aperture therein and terminates in a force transmitting knob 22 which projects outwardly from the rotator. The blade may be formed into any of a number of shapes other than the curved one whose cross-section is shown in FIG. 3; for example, it could be shaped like a spatula in order to be able to scrape the inner wall of the jar 12. It can be seen that the rotator 16 will freely rotate within the mix lid 14 and the blade 20 will itself separately rotate within the rotator.

The transfer lid 26 has a plurality of empty caulk tubes 28 connected to it using their nozzles 32.

Figure 4:
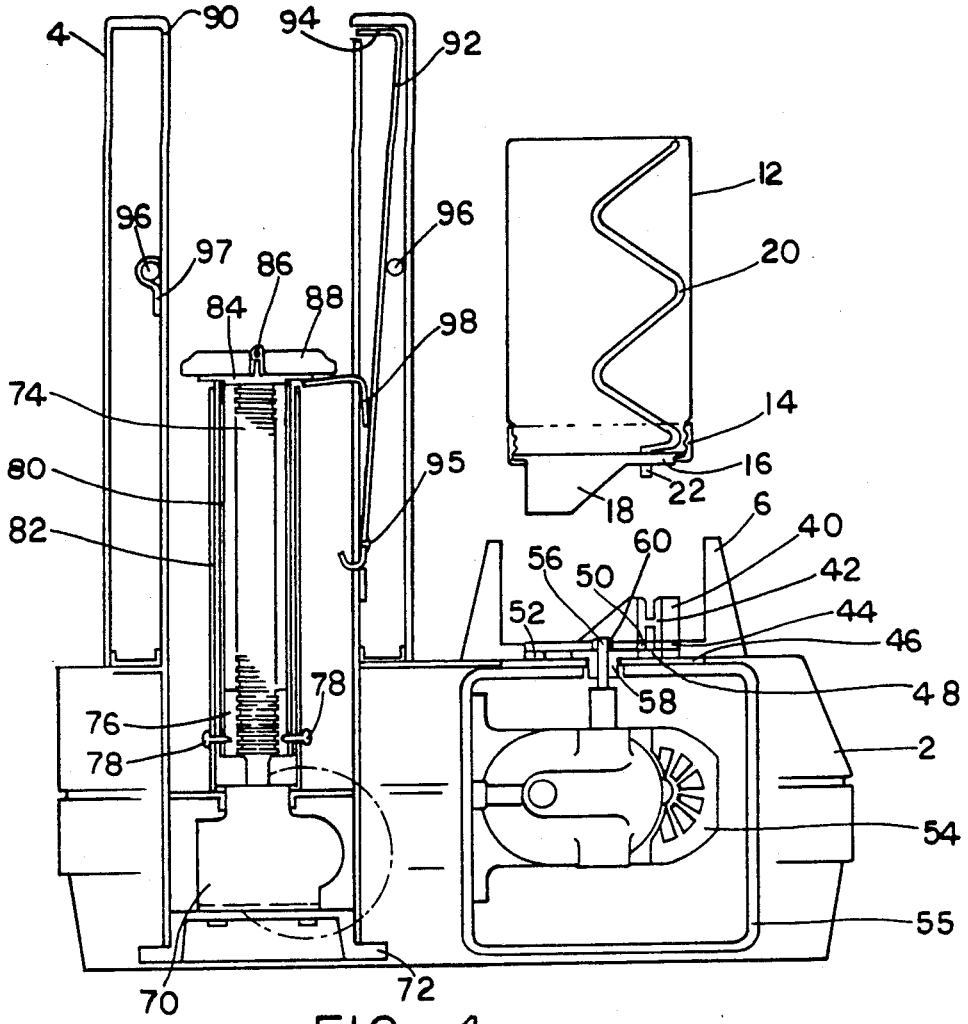
FIG. 4 is a elevational view of the machine of FIG. 1 with various features shown in partial section.

Turning to FIG. 4, and with further reference back to FIG. 1, the co-operation between the jar 12, when its mix lid 14 is attached, and the mix and transfer machine 1 will be discussed. The cap 18 of the mix lid is configured to firmly engage a force transmitting machine rotator 40 which projects upwardly from within the jar socket 6 of the machine. The knob 22 of the jar's blade 20 is configured to firmly engage within a socket 42 in the rotator. The socket is connected to a gear 48 and is rotatably supported by a bearing 50.

The machine rotator 40 is affixed to a rotation disk 44 that is supported by a bearing 60 on the drive shaft 56 of a motor 54, the latter of which is supported within the machine on a mount 55. The shaft 56 drives a gear 58 located above a base disk 46, which gear, in turn, drives the socket gear 48 and turns the blade 20 within its aperture in the mix lid rotator 16.

The socket gear turns a ring gear 52 affixed to the rotation disk 44. This turns the machine rotator 40 which, in turn, turns the mix lid rotator 16 within the mix lid 14. Thus, a complex motion of the mix blade 20 is established. The blade rotates about the axis of its knob 22 and, at the same time, the blade, knob and all, rotates about the central axis of the jar 12, which latter axis passes through the center of the mix lid rotator 16. This causes a very complete mixing of the caulk 13 within the jar, to which pigment has previously been injected.

FIG. 4, along with the sequential detail views of FIG. 5, also can be used to show the co-operation between the machine 1 and the bulk jar after the latter has had its contents mixed, its mix lid removed and discarded, and its transfer lid 26 screwed in place.

A linear actuator 70 mounted on a base 72 may be driven by the motor 54 or by separate or integral means of motivation. The actuator turns a screw 74 which causes a nut 76 to translate upwardly and downwardly along the axis of the screw. The nut drives a ram 80, which ram is constrained from rotation by anti-rotation pins 78 that travel up slots in a ram shroud 82. The ram terminates at its upper end in a head or piston 84. The piston may include a hinge 86 about which one or more flaps 88 may rotate above, but not below, the plane of the piston.

With particular reference to the views of FIG. 5, it can be seen that the ram and piston translate up and down within a compression tube 90. The diameter of the compression tube is narrow enough to encapsulate and confine a jar 12 and its transfer lid 26. As shown in FIG. 5A, when the piston is fully retracted downwardly it trips an actuator 98, forcing a stop arm 92 outwardly away from the compression tube. This causes a finger 94 on the upper end of the stop arm to withdraw from the compression tube. At this point a bulk jar may be inserted or removed from the tube.

Preferably, there are a plurality of stop arms and associated actuators, as shown in the drawing. Each stop arm has a spacer 95 which acts as a pivot fulcrum. The stop arms are surrounded by a compression ring spring 96 which is attached to the outside of the compression tube 90 by at least one clip 97.

Figure 5D:
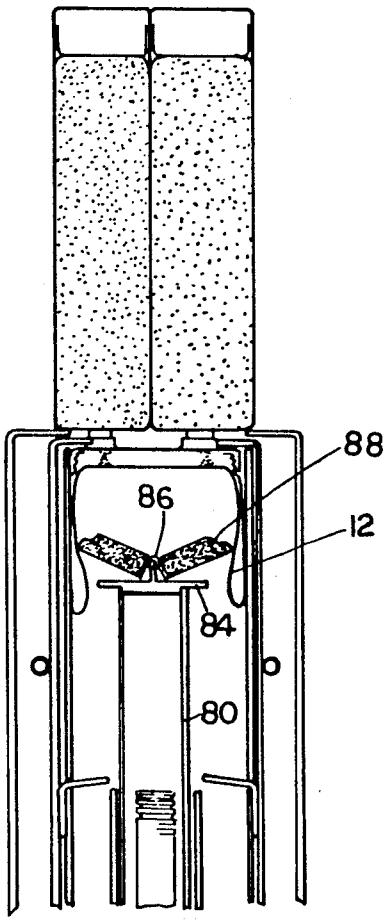
FIG. 5 is a series of broken sectional views showing the process of transferring caulk from the bulk jar to caulk tubes.
Figure 5C:
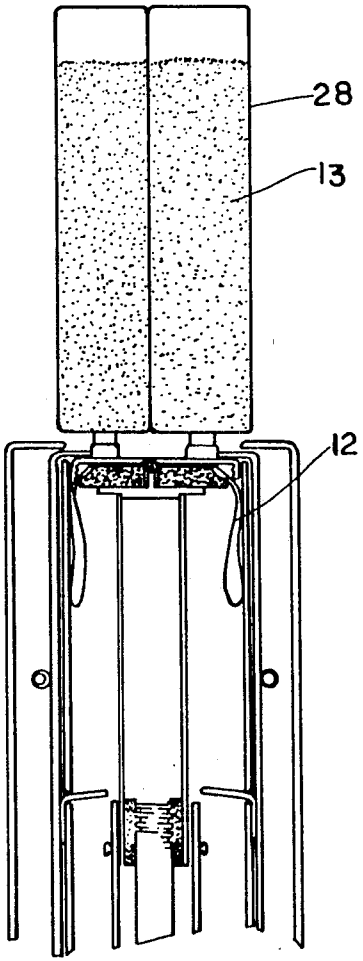
Figure 5B:
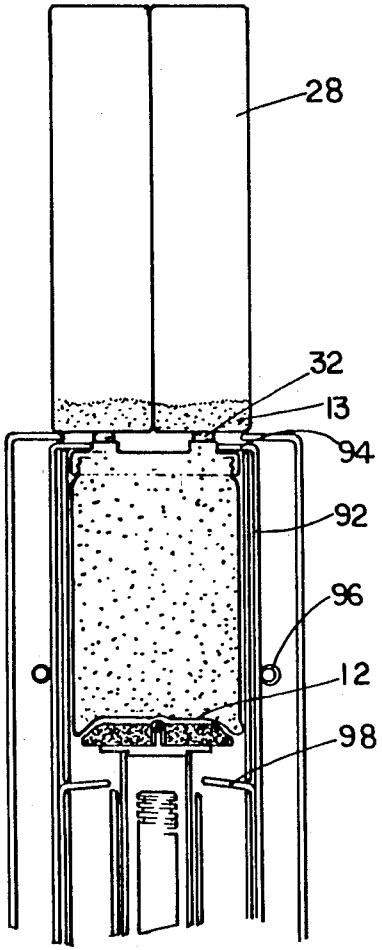

FIG. 5B demonstrates that once the piston travels upward from its lowermost position, the ring spring causes each stop arm actuator 98 and its associated stop arm 92 to collapse inwardly. This inserts the stop arm fingers 94 into the compression tube 90 via slots therein, which fingers then grip the top of the jar and restrain it against upward movement.

The caulk jar is preferably formed of one continuous piece of flexible plastic. As the piston moves up the compression tube (FIGS. 5B and 5C) the jar inverts; that is to say, its bottom and the piston enter the interior of the jar and the wall of the jar turns inward upon itself. Mixed caulk 13 is forced out of the jar through apertures 34 in the transfer lid 26 and into the caulk tubes 28 through the tubes' nozzles 32, which nozzles are attached to the transfer lid in fluid communication with the apertures 34.

Figure 5A:
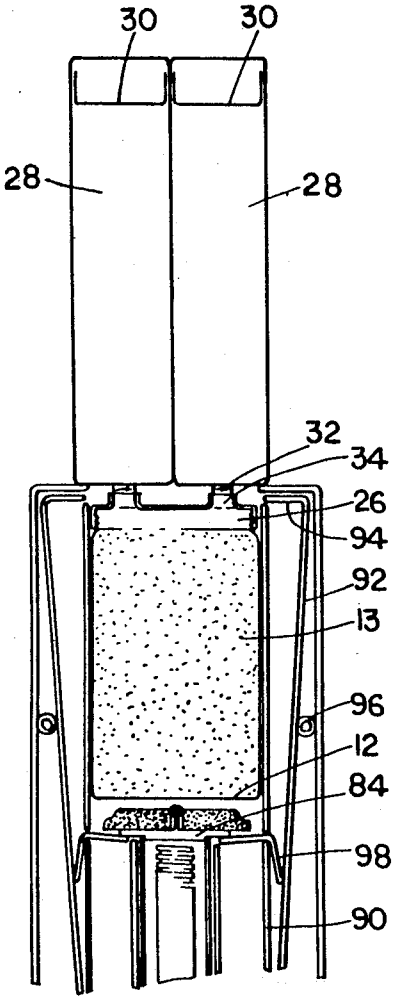

Moveable plungers 30, as are commonly found in existing caulk tubes, may be located at the bottom of the tubes 28 (shown inverted in FIG. 5) at the start of the transfer cycle, as found in FIG. 5A. If so, a small weep hole will be needed in each tube plunger or in the top of the tube wall in order to allow air to escape during transfer. When full, the weep holes will become clogged with caulk and thereby be permanently sealed. Alternatively, the tube plungers 30 may begin the cycle at the top of the tubes (i.e. at the nozzle end) and travel upwardly during transfer, thus eliminating the need for weep holes.

At the end of the upward stroke, as shown in FIG. 5C, the jar is substantially completely emptied of caulk. To facilitate complete transfer, the flaps 88 of the piston (or the piston itself, in the case of a flapless piston) are shaped congruently with interior of the jar in the vicinity of its mouth and transfer lid.

The wall of the bulk jar 12 is made of resilient plastic so as to invert under the pressure of the piston. The inversion may not be perfect, i.e. there may be some bulges or folds on the interior of the inverted jar which could interfere with the removal of the piston after completion of the caulk transfer. As shown in FIG. 5D, the hinge 86 allows the flaps 88 to rotate upwardly on the reset or down stroke of the ram 80. This allows free removal of the piston from the inverted jar.

The preferred bulk jar 12 has a slightly constricted throat in the vicinity of the lid threads. This allows a lid to be screwed on without significantly increasing the external diameter of the jar, a feature which is of some use in providing a close fit within the compression tube 90.

Figure 6:
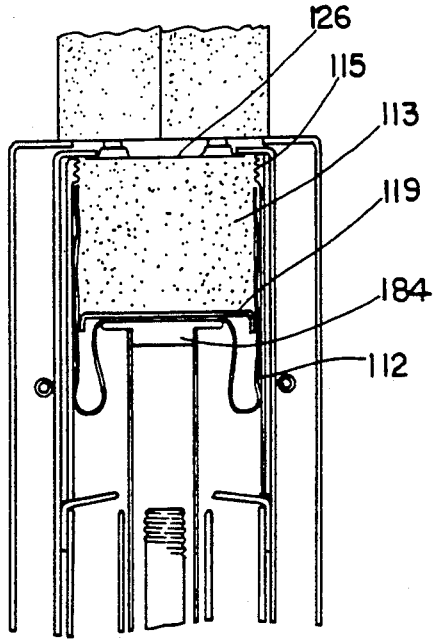
FIG. 6 is a broken sectional view showing a step in the transfer process using an alternate embodiment of the bulk jar.

Alternatively, the bulk jar 112 shown in FIG. 6 has threads 115 which project outwardly from the jar wall. Such a jar eliminates the throat constriction, i.e. it has a substantially constant internal diameter. This is a feature which is useful in order to be able to easily insert an internal plunger 119 into the jar 112. The plunger 119 is then used to facilitate jar inversion in an alternate embodiment of the invention. With such a plunger 119, a much smaller ram head or piston 184 may be used, since it is the plunger and not the piston which scrapes and seals the wall of the jar as the caulk 113 is forced up and out through the transfer lid 126. A smaller piston 184 may be retracted from the inverted jar without the need for hinged flaps.

It can be seen that the standard caulk tubes 28 illustrated in the drawing could be exchanged for invertible caulk tubes. Such tubes would function in co-operation with the ram pistons of standard caulk guns in a manner similar to the bulk jars 12, 112. Similarly, this invention may be practiced with a bulk jar constructed in the manner of conventional caulk tubes; i.e. one which does not invert but, rather, has a plunger which moves within a rigid wall.

To recapitulate, caulk may be custom colored at the point of retail sale with the apparatus of the present invention as follows. Bulk uncolored caulk 13 is shipped in a bulk jar 12. Pigment is added to the jar in the desired proportion with existing paint pigmenting equipment. The mix lid 14 is then screwed onto the bulk jar. The top of the jar is inserted into the jar socket 6 of the mix and transfer machine 1. The power is turned on with switch 8 and the mix operation is begun by pressing an appropriate button of the control array 10. The caulk is thoroughly mixed by allowing sufficient time for completion of a pre-selected number of rotations of the jar's blade 20. This may by accomplished through use of an automatic timing mechanism.

After mixing, the jar is removed from the jar socket, the mix lid is removed and discarded, and the transfer lid 26 is substituted in its place. The jar is then inserted into the compression tube 90. Pressing the appropriate button on array 10 initiates the transfer operation. Once the head or piston 84 of the ram 80 has completely inverted the jar, substantially all of the custom colored caulk has been transferred into caulk tubes 28. The tubes may be removed from the transfer lid, the transfer lid and jar discarded and the tubes used to apply colored caulk from standard caulk guns. The piston may be retracted by a button of the array 10 to reset the machine, or provision may be made for automatic resetting.

While the above provides a full and complete disclosure of the preferred embodiments of this invention, various modifications, alternate constructions, and equivalents may be employed without departing from the true spirit and scope of the invention. Such changes might involve alternate materials, components, structural arrangements, capacities, sizes, timing, operational features or the like. Therefore, the above description and illustrations should not be construed as limiting the scope of the invention which is defined by the appended claims.

I claim:

1. A machine for mixing pigment and caulk in a caulk jar having at least one lid and for transferring the mixture to caulk tubes including:

means for engaging the jar and mixing the pigment and caulk therein; and means for engaging the jar and transferring the mixture to the caulk tubes;

and wherein the engaging and mixing means includes a socket for engaging the jar and means for rotating at least one part of the jar lid; and the engaging and transferring means includes a compression tube for engaging the jar and means for pushing the mixture into caulk tubes.

2. The apparatus of claim 1 wherein:

the pushing means is a ram having a piston.

3. The apparatus of claim 2 wherein:

the engaging and transfer means further includes at least one moveable stop arm terminating in a finger which finger grasps the jar when the stop arm is in a first position and which finger releases the jar when the stop arm is in a second position.

4. Caulk and pigment mix and transfer apparatus including:

at least one caulk tube;

a caulk jar having caulk and at least two caulk jar lids;

wherein one jar lid is a mix lid having a rotatable blade; and one jar lid is a transfer lid to which the at least one caulk tube is removably attached so as to allow the mixture to enter into fluid communication with the jar;

and further including a machine for mixing pigment and the caulk in the caulk jar and for transferring the mixture to the at least one caulk tube, the machine having means for engaging the jar and mixing pigment and the caulk therein, and means for engaging the jar and transferring the mixture to the at least one caulk tube.

5. The apparatus of claim 4 wherein:

the mix lid includes a rotator;

the engaging and mixing means includes a socket for engaging the jar and means for rotating the rotator of the jar mix lid; and the engaging and transferring means includes a compression tube for engaging the jar and means for pushing the mixture through the transfer lid into the at least one caulk tube.

6. The apparatus of claim 5 wherein:

the rotating means rotates the blade in addition to and independently of the rotation of the rotator of the mix lid.

7. Caulk and pigment mix and transfer apparatus including:

at least one caulk tube;

a caulk jar having caulk and at least one lid; and a machine for mixing pigment and the caulk in the caulk jar and for transferring the mixture to the at least one caulk tube, the machine having means for engaging the jar and mixing pigment and the caulk therein, and means for engaging the jar and transferring the mixture to the at least one caulk tube, and wherein the caulk jar is formed of one continuous piece of flexible plastic forming a jar wall and a jar bottom and the engaging and transfer means includes means for inverting the jar to push the mixture into the at least one caulk tube.

8. The apparatus of claim 7 wherein:

the engaging and mixing means includes a socket for engaging the jar and means for rotating at least one part of the jar lid;

the engaging and transferring means further includes a compression tube for engaging the jar; and the inverting means is a piston on a moveable ram, which piston is configured to enter the interior of the jar and to cause the jar bottom to enter the interior of the jar and the jar wall to turn inward upon itself.

9. Caulk and pigment transfer apparatus including:

at least one caulk tube;

a caulk jar having caulk and pigment mixed together and a lid for holding the at least one caulk tube; and means for engaging the jar and transferring the mixture from the jar through the lid into the at least one caulk tube, wherein the caulk jar is formed of one continuous piece of flexible plastic forming a jet wall and a jar bottom and the engaging and transfer means includes means for inverting the jar to push the mixture into the at least one caulk tube.

10. The apparatus of claim 9 wherein:

the engaging and transferring means further includes a compression tube for engaging the jar; and the inverting means is a piston on a moveable ram, which piston is configured to enter the interior of the jar and to cause the jar bottom to enter the interior of the jar and the jar wall to turn inward upon itself.

11. The apparatus of claim 9 wherein:

the engaging and transfer means further includes at least moveable one stop arm terminating in a finger which finger grasps the jar when the stop arm is in a first position and which finger releases the jar when the stop arm is in a second position.

* * * * *